US006290521B1

(12) United States Patent
Suzuki et al.

(10) Patent No.: US 6,290,521 B1
(45) Date of Patent: Sep. 18, 2001

(54) CONNECTOR WITH LOCKING MEMBERS

(75) Inventors: Izumi Suzuki; Yukihiro Fukatsu; Kiyofumi Ichida, all of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/545,829

(22) Filed: Apr. 10, 2000

(30) Foreign Application Priority Data

Apr. 13, 1999 (JP) ..... 11-105919
Apr. 13, 1999 (JP) ..... 11-105920
Apr. 26, 1999 (JP) ..... 11-118479

(51) Int. Cl.[7] ..... H01R 29/00
(52) U.S. Cl. ..... 439/189; 439/595
(58) Field of Search ..... 439/189, 595, 439/511, 752, 597–599

(56) References Cited

U.S. PATENT DOCUMENTS 5,000,699 * 3/1991 Nadin ..... 439/511
5,201,667 * 4/1993 Endo et al. ..... 439/189
5,462,450 * 10/1995 Kodama ..... 439/489
5,525,077 * 6/1996 Badaroux ..... 439/595
5,554,052 * 9/1996 Saijo et al. ..... 439/595
5,655,928 * 8/1997 Akeda ..... 439/489
5,746,624 * 5/1998 Ohsumi et al. ..... 439/595
5,769,650 * 6/1998 Aoyama et al. ..... 439/189
5,890,932 * 4/1999 Muta ..... 439/682
5,944,557 * 8/1999 Fukuda ..... 439/595
6,068,512 * 5/2000 Sugie ..... 439/595

FOREIGN PATENT DOCUMENTS

U-2-61082 5/1990 (JP) .
U-4-42082 4/1992 (JP) .
A-9-213436 8/1997 (JP) .

* cited by examiner

*Primary Examiner*—Brian Sircus
*Assistant Examiner*—Son V. Nguyen
(74) *Attorney, Agent, or Firm*—Oliff & Berridge, PLC

(57) ABSTRACT

A connector for electrical terminals includes a housing that has a plurality of cavities, a plurality of respective resiliently deformable locking members, and a plurality of respective terminals. Each terminal is inserted in a respective cavity and has (a) a partially inserted position in which the terminal bears on the respective locking member to deform the locking member so that the locking member is raised with respect to a peripheral surface of the housing, and (b) a fully inserted position in which the locking member snap-fits to the terminal thereby locking the terminal in said cavity. The connector further includes a bus bar holder having a sleeve which accommodates a plurality of bus bar tab pieces. The sleeve is push-fitted over the peripheral surface of the housing to install the bus bar holder to the housing and to contact the tab pieces to the terminals, whereby the terminals are electrically connected to each other. Each locking member has an end surface portion which is adapted so that when, on push-fitting of the sleeve, a terminal is in the partially inserted position with the respective locking member raised with respect to the peripheral surface of the housing, the sleeve bears on the end surface portion to prevent installation of the bus bar holder.

5 Claims, 11 Drawing Sheets

CONNECTOR WITH LOCKING MEMBERS

BACKGROUND OF THE INVENTION

1. Field of Invention

The present invention relates to a connector, particularly a connector for use in the wiring of a vehicle such as an automobile.

2. Description of Related Art

A connector disclosed in Japanese Patent Application Laid-Open No. 9-213436 is described below. The connector has a housing into which a plurality of terminals are inserted from a rear portion thereof and a bus bar holder in which a holding member holds a plurality of bus bars each of which has a tab piece projecting from a side edge of a belt-shaped carrier. The bus bar holder is inserted into an opening at the front surface of the housing to connect the tab pieces with the terminals. In this manner, the terminal fittings are electrically connected to each other.

It is also known to lock the terminals into a position in the housing with a plurality of respective locking lances. Theses lances may project outwardly from the housing if the terminals are not fully inserted.

The tab pieces project from the holding member of the bus bar holder and are externally exposed. Therefore, when the bus bar holder is packed in a bag or a box for delivery, or when it is installed to the housing, other bus bar holders may catch on the tab pieces. Thus, there is a risk that the tab pieces can be deformed or damaged.

To prevent such risk, it is known to use a bus bar holder having a protective cylindrical sleeve which accommodates the tab pieces. This construction has an advantage of helping to prevent the tab pieces from being deformed or broken.

Also, with this arrangement the bus bar holder is capable of detecting incomplete insertion of the terminals in the connector housing. When the terminals are fully inserted into the connector housing, the sleeve can be installed onto the housing without interfering with the locking members which hold the terminals in place. On the other hand, when any of terminals is not properly inserted into the connector housing, the respective locking member projects from the peripheral surface of the housing and collides with the end surface of the sleeve on installation. That is, the proper or improper insertion of the terminals can be detected by whether the sleeve interferes with the locking members.

However, when a projecting lance collides with the cylindrical sleeve, the lance may flex excessively, possibly breaking or damaging the lance.

SUMMARY OF THE INVENTION

It is therefore an object of the present invention to prevent a locking member or lance from flexing excessively when a bus bar holder is installed on a connector housing and the respective terminal is not properly inserted.

According to the present invention there is provided a connector for electrical terminals. The connector has a housing with a peripheral surface, a plurality of cavities, a plurality of resiliently deformable locking members, and a plurality of terminals. Each terminal is inserted in a respective cavity and has (a) a partially inserted position in which the terminal bears on the respective locking member to deform the locking member so that the locking member is raised with respect to a peripheral surface of the housing, and (b) a fully inserted position in which the locking member snap-fits to the terminal thereby locking the terminal in the cavity.

The connector also has at least one bus bar holder with a sleeve and a plurality of bus bar tab pieces which are accommodated in the sleeve. The sleeve is push-fitted over the peripheral surface of the housing to install said bus bar holder to the housing and to contact the said tab pieces to the terminals. In this way the terminals are electrically connected to each other.

Each locking member has an end surface portion which is inclined with respect to the push-fit direction of the sleeve. Therefore, when, on push-fitting of the sleeve, a terminal is in its partially inserted position with the respective locking member raised with respect to peripheral surface, the sleeve bears on the respective first end surface portion to urge the locking member toward the terminal. This prevents excess deformation of the locking member from occurring.

Each of the locking member may also have a second end surface portion which faces the first end surface portion and, with respect to the first end surface portion, is oppositely inclined with respect to the push-fit direction of the sleeve. In this way, when, on push-fitting of the sleeve, each terminal is in its partially inserted position with the respective locking member raised with respect to the peripheral surface, the sleeve also bears on the second surface portion to urge the locking member away from the terminal.

The first and second end surface portions may, for example, define a V-shaped recess in the respective locking members.

When the sleeve of the bus bar holder contacts both the first and the second end surface portions of a locking member, the locking member experiences opposing and balance forces on its end surface portions. These forces prevent it from being displaced either away from or toward the terminal. Thus the installation of the bus bar holder on the housing is prevented. That is, even though the bus bar holder is urged strongly against the locking member, the locking member is prevented from being forcibly displaced in a direction which would remove its elastic deformation. Therefore, the locking member is prevented from being pressed against the terminal with an excessive force and possibly being damaged.

Preferably, the angle of inclination of the first end surface portion with respect to the push-fit direction of the sleeve is smaller than the angle of inclination of the second end surface portion with respect to the push-fit direction when the sleeve bears on both the first and second end surface portions.

With this arrangement, the force applied to a locking member by the sleeve in the direction which would remove its elastic deformation (i.e. toward the terminal) is greater than the force applied in the direction which would increase its elastic deformation (i.e. away from the terminal). Accordingly, it is possible to avoid excess flexing and deformation of the locking member.

BRIEF DESCRIPTION OF THE DRAWINGS

Preferred embodiments of this invention will be described in detail by way of non-limitative example with reference to the following drawings, in which.

DETAILED DESCRIPTION OF PREFERRED EMBODIMENTS

Figure 1:
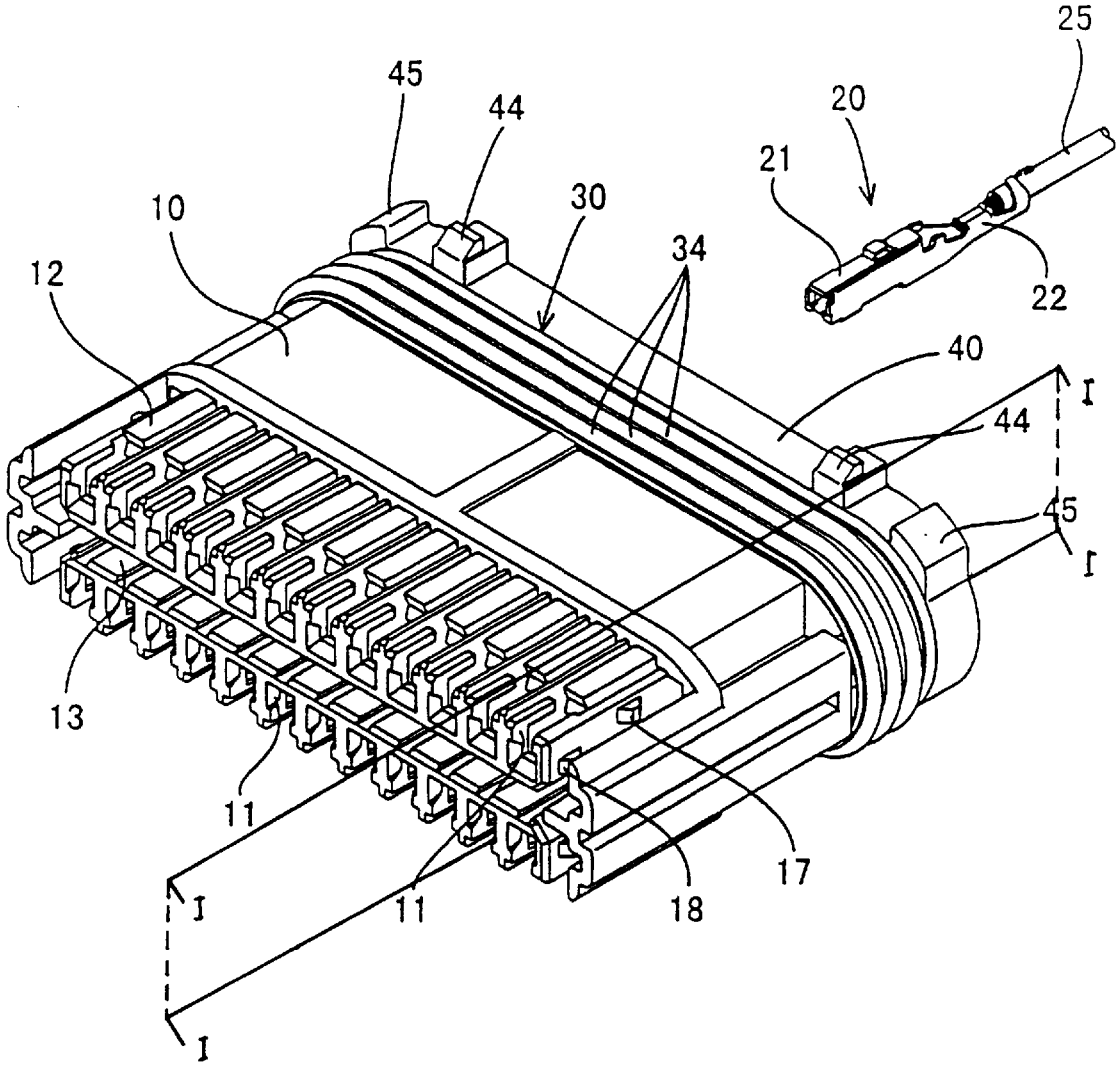
FIG. 1 is a perspective view of a housing of a connector according to the invention.

A connector embodying the present invention is described in conjunction with FIGS. 1 to 13. The connector electrically connects a plurality of terminals 20 in a predetermined connection pattern with a bus bar 55 and includes a housing 10, a plurality of the terminals 20, a sealing member 30, a seal holder 40, two bus bar units 50, and a cap 60.

Figure 5:
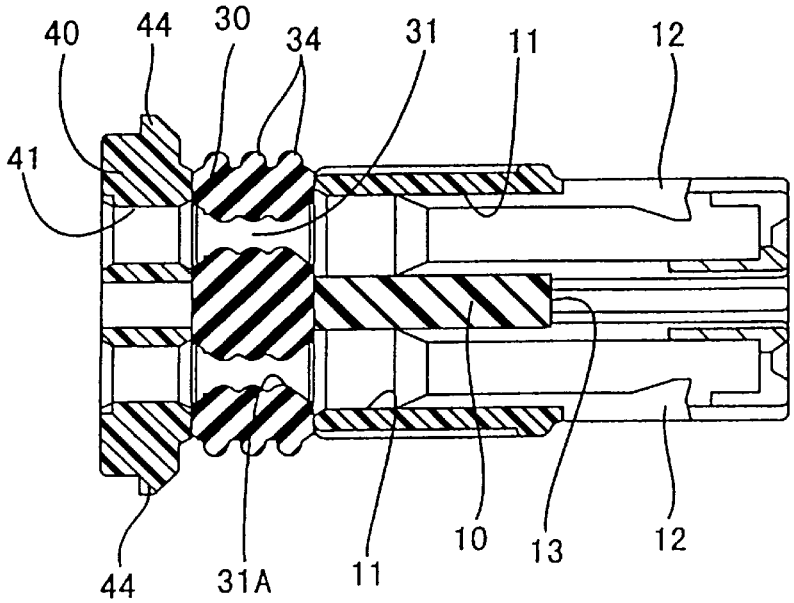
FIG. 5 is a sectional view on plane I—I of FIG. 1, showing a sealing member and a seal holder installed on the housing.

The housing 10 is made of a synthetic resinous material. As shown in FIGS. 1 and 5, the housing 10 may have cavities 11 arranged in upper and lower rows and extending through the housing 10 in a front-to-rear direction. In each of the upper and lower rows, the cavities 11 may be arranged widthwise at regular intervals. The front half regions of the upper-row cavities 11 and the lower-row cavities 11 are open at the upper and lower surfaces of the housing 10, respectively. In each open portion, locking members, such as locking lances 12, project forward in a cantilever manner. Between the upper and lower rows of the cavities 11 there is formed a wide recess 13 for allowing the peripheral walls of the bus bar units 50, as described below, to penetrate. An upper surface wall and a lower surface wall of the recess 13 are partly cut away to allow communication with the cavities 11.

Figure 8:
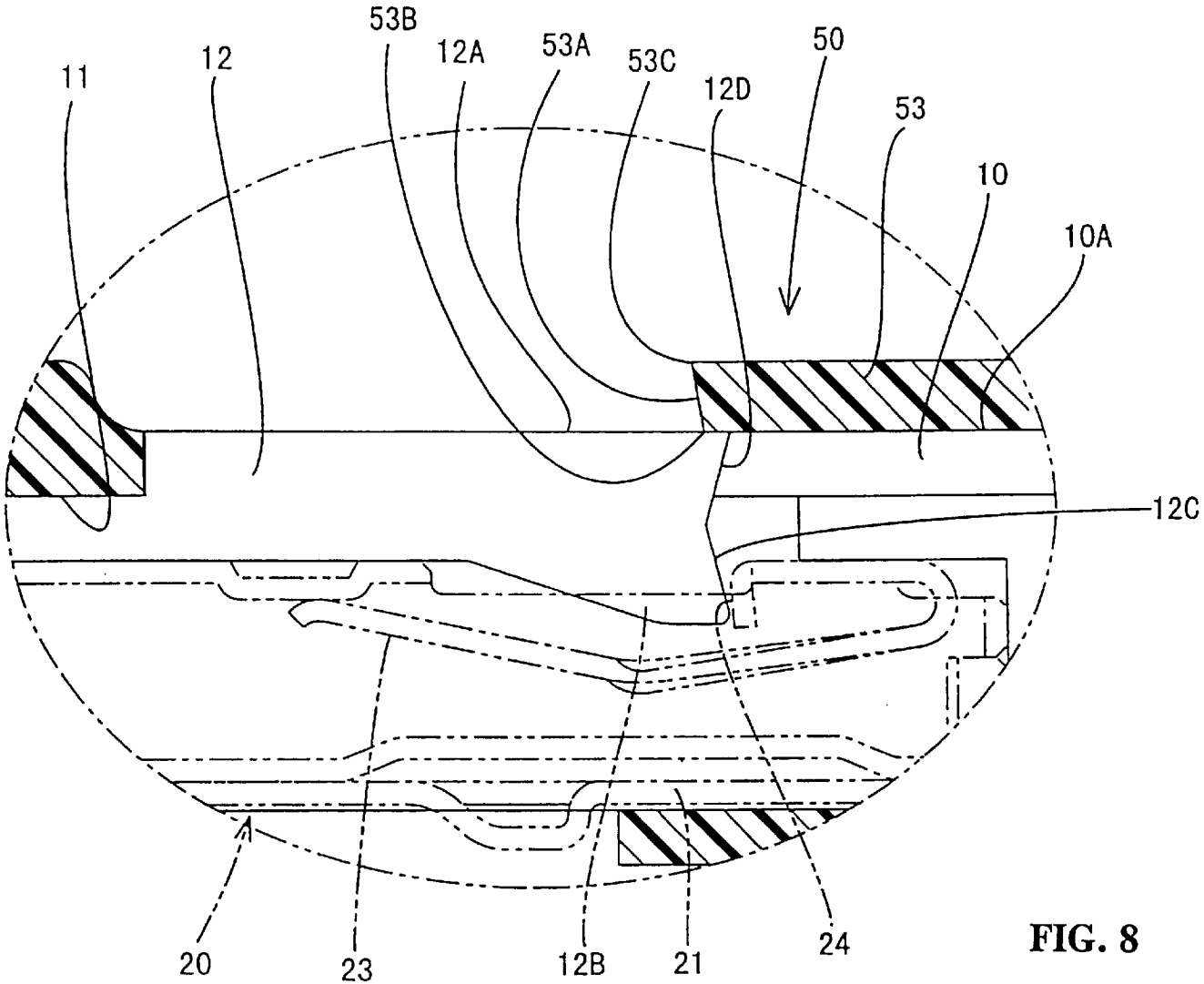
FIG. 8 is an enlargement of a part of the sectional view of FIG. 4, showing a terminal fully inserted into the housing.
Figure 9:
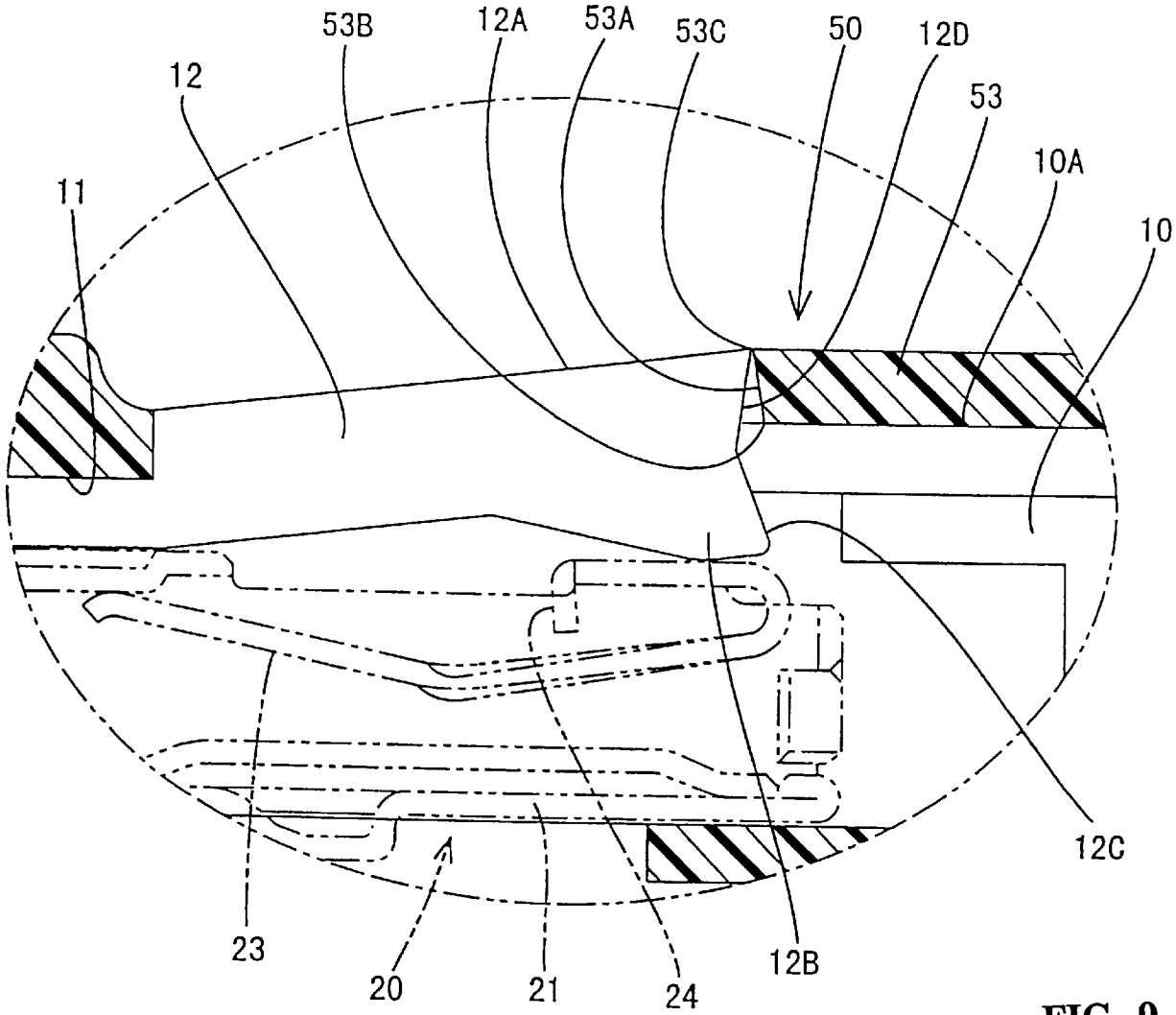
FIG. 9 is the same view as FIG. 8 except that the terminal is partially inserted into the housing.

The locking lances 12 retain and prevent the removal of the terminals 20 inserted into the cavities 11. In cooperation with a cylindrical portion 53 of the bus bar unit 50 shown in FIGS. 8–10, locking the lances are also used for detecting the degree of insertion of the terminals 20. The locking lances 12 can be outwardly elastically displaced relative to an outer surface 10A of the housing 10. As shown in FIG. 8, before a terminal 20 is inserted into a cavity 11 and after the terminal 20 is fully inserted therein, a corresponding locking lance 12 is undeformed, and an outer surface 12A of the locking lance 12 is flush with the outer surface 10A of the housing 10. In this state, when the terminals 20 are fully inserted, a removal prevention projection 12B formed at a front end of each locking lance 12 is engaged in a locking hole 24 of the terminal 20, thus preventing removal of each terminal 20. However, as shown in FIG. 9, when any of the terminals 20 are not fully inserted, the removal prevention projection 12B interferes with the outer surface of a mating portion 21 of the terminal 20. As a result, as described in FIG. 10, the locking lance 12 is elastically displaced such that its outer surface 12A is located outwardly from the surface 10A of the housing 10. Therefore, when a bus bar unit 50 is installed on the housing 10, the cylindrical portion 53 of the bus bar unit 50 collides with the front end of the locking lance 12. This prevents the bus bar unit 50 from being installed on the housing 10.

Figure 10:
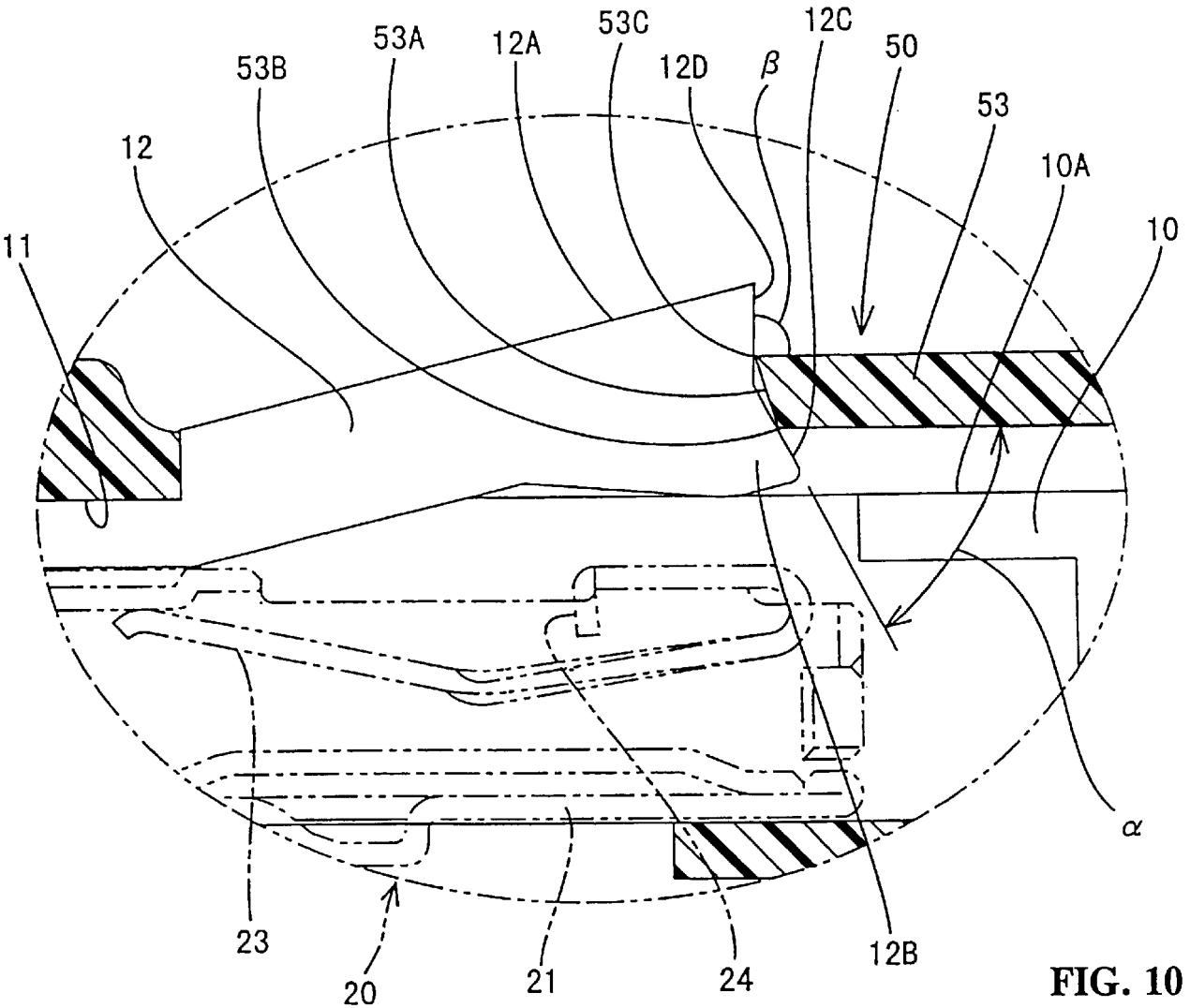
FIG. 10 is the same view as FIG. 9 except that a locking lance of the housing is further deformed by a sleeve of the bus bar holder.

At the front-end surface of each locking lance 12, there is formed an excess flexure prevention surface 12C that prevents the locking lance 12 from flexing excessively beyond the limit of its elasticity, when the cylindrical portion 53 collides with the front end of the locking lance 12. At the front-end surface of each locking lance 12, there is also formed a balancing surface 12D inclining in a direction opposite to the direction of inclination of the excess-flexure prevention surface 12C. For example, in a side view, the front-end surface of the locking lance 12 may be recessed in the shape of a "V", as shown in FIGS. 8–10. The inward side, i.e., the terminal side, of the front-end surface of the locking lance 12 is the excess-flexure prevention surface 12C and the outer side of the front-end surface is the balancing surface 12D.

While the surfaces 12C and 12D form a "V" shape in FIGS. 8–10, it will be appreciated that other shapes are possible. For example, the surfaces 12C and 12D may form a curved "U" shape, rather than being linear surfaces that form a "V". Additionally, rather than two linear surfaces, one or more of the surfaces may be curved, and/or more than two surfaces may be provided at the end of each locking lance 12.

While the locking lance 12 is elastically displaced within its elastic limit, an end surface of the cylindrical portion 53 collides with the excess-flexure prevention surface 12C when each bus bar unit 50 is installed on the housing 10. The excess-flexure prevention surface 12C is so inclined that the excess-flexure prevention surface 12C stops and reduces excess elastic deformation of the locking lance 12, as best shown in FIG. 10.

While the locking lance 12 is elastically displaced within its elastic limit, the cylindrical portion 53 is also capable of colliding with the balancing surface 12D, when each bus bar unit 50 is installed on the housing 10. The balancing surface 12D is inclined so that the locking lance 12 is then urged in a direction in which the elastic displacement of the locking lance 12 increases (upward in FIGS. 8 to 10). Ultimately the cylindrical portion 53 contacts both the excess-flexure prevention surface 12C and the balancing surface 12D, as shown in FIG. 10. Comparing the relative inclinations of the excess-flexure prevention surface 12C and the balancing surface 12D when both surfaces are in contact with the cylindrical portion 53, as shown in FIG. 10, the acute angle $\alpha$ between the direction of insertion of the cylindrical portion 53 and the excess-flexure prevention surface 12C is smaller than the angle $\beta$ between the insertion direction the cylindrical portion 53 and the balancing surface 12D.

Each terminal 20 is made of a metal plate material punched into a predetermined configuration. As shown in FIG. 1, the front half part of the terminals 20 may be formed as a square pillar-shaped mating portion 21 that is open forward and rearward. The rear half of the terminals 20 is formed as an electric wire connection portion 22 that may be crimped to the core of an electric wire 25.

Figure 4:
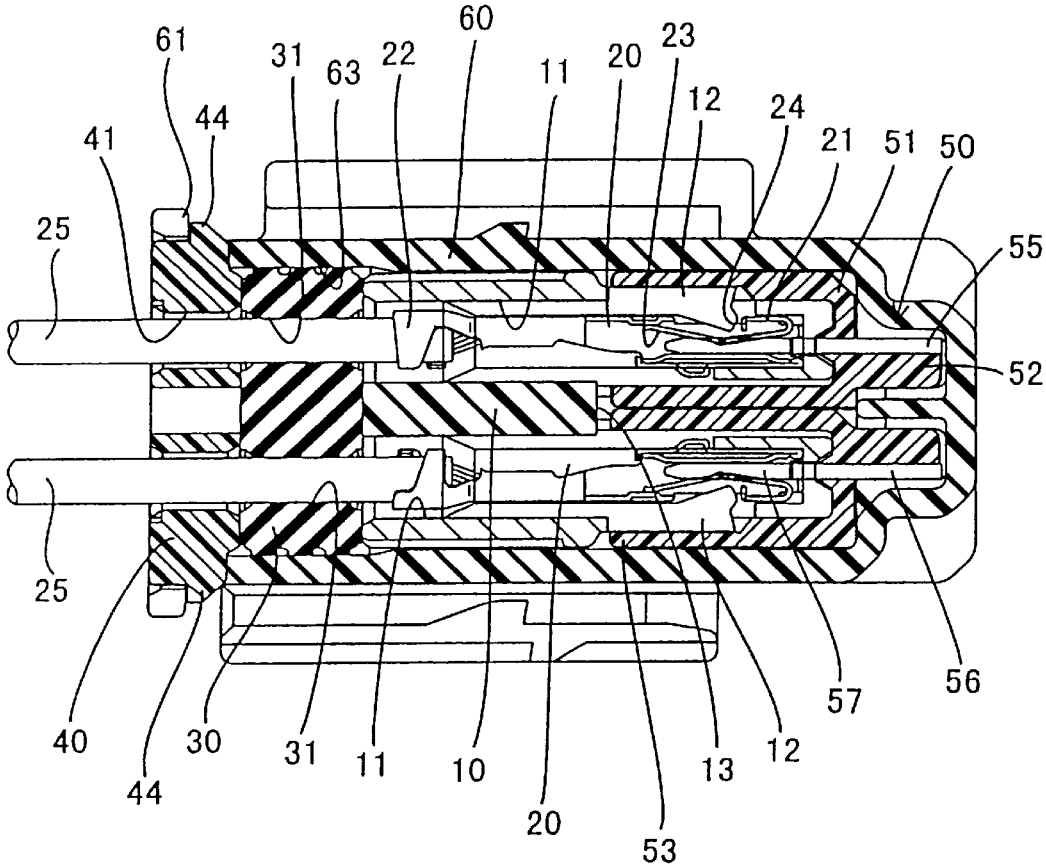
FIG. 4 is a sectional view of the connector in an engagement state on plane I—I of FIG. 1, plane II—II of FIG. 2 and plane III—III of FIG. 3.

As shown in FIG. 4, a resilient contact piece 23 that contacts a connection piece 57 of a bus bar 55 is formed inside the mating portion 21. A locking hole 24 which the locking lance 12 of the housing 10 engages is formed on a peripheral wall of the mating portion 21. The terminals 20 are inserted into the cavities 11 of the housing 10 by passing through the sealing member 30 and the seal holder 40 at the rear of the housing 10. Immediately before the terminals 20 reach the fully inserted position, the locking lances 12 interfere with the peripheral surface of the mating portions 21. Therefore, the locking lances 12 flex elastically outward from the housing 10. When the terminals 20 reach the fully inserted position, the locking lances 12 are elastically restored to the original state and are engaged in the locking holes 24, thus preventing the terminals 20 from being removed from the cavities 11. The orientation of the terminals in the upper row of cavities 11 may be reversed relative to that of the terminals in the lower cavity row.

The sealing member 30 is made of rubber, oval-shaped, and thick. As shown in FIG. 5, the sealing member 30 is installed on the housing 10 and is sandwiched between the rear end surface of the housing 10 and the front end surface of the seal holder 40. The construction of the sealing member 30 with the housing 10 and the seal holder 40 is described in more detailed below with reference to FIGS. 11–13. A plurality of sealing holes 31 opened through the sealing member 30 is formed coincident with the cavities 11 of the housing 10. Each sealing hole 31 may be circular, for example. A lip portions 31A may have a corrugated shape that includes, for example, three convexities. The convexities are circumferentially formed on the inner peripheral surface of each sealing hole 31. The inner diameter of the lip portion 31A is smaller than the outer diameter of the coating of the wire 25. When the wire 25 is in the sealing hole 31, the lip portion 31 A contacts the peripheral surface of the wire 25 elastically, thus sealing around the wire 25. Furthermore, as shown in FIG. 12, the sealing member 30 includes fit-in holes 32 and 33 through which holding projections 14 and deformation prevention projections 15 pass, respectively.

Figure 11:
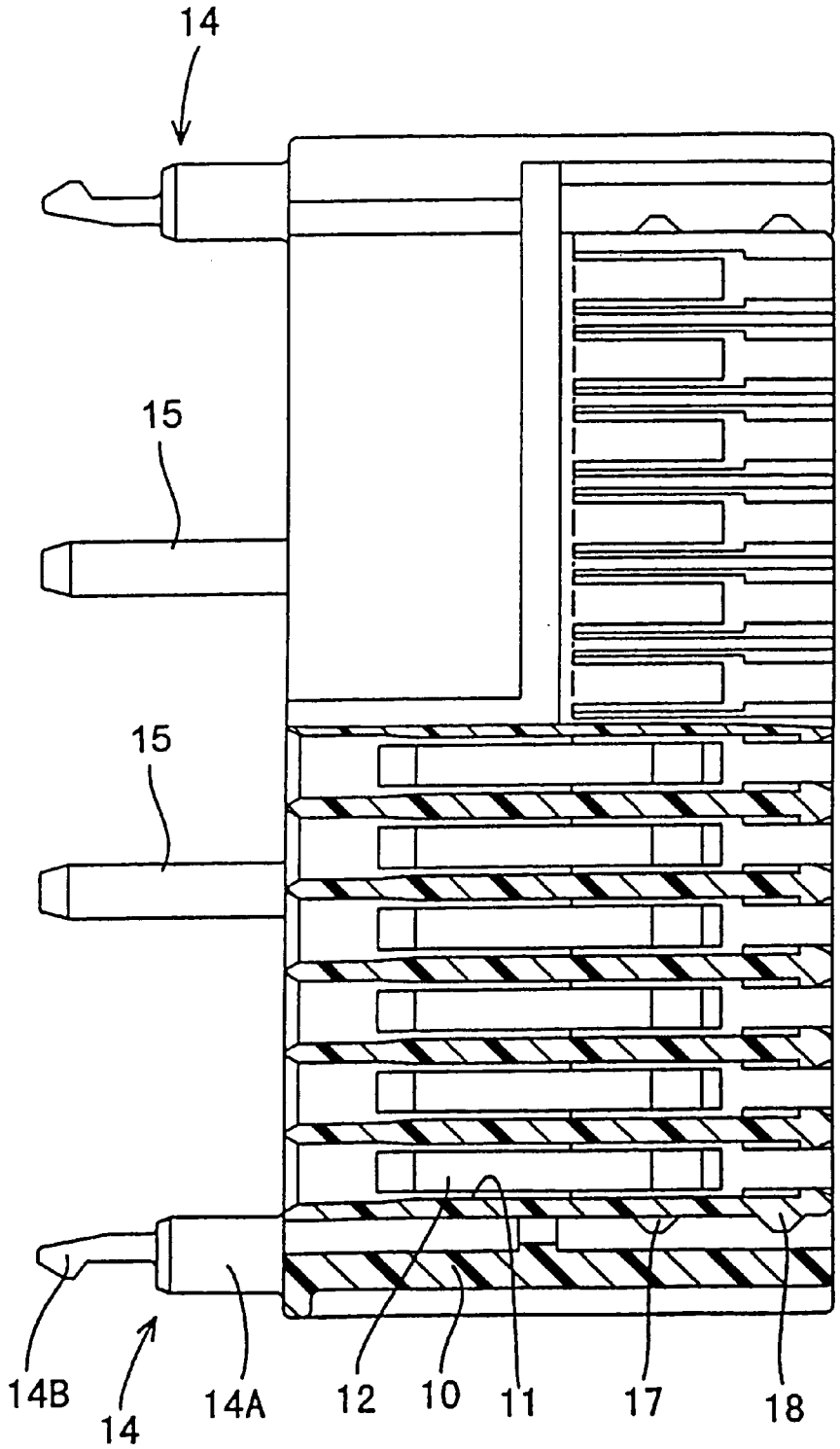
FIG. 11 is a partly cut-away plan view of the housing.
Figure 12:
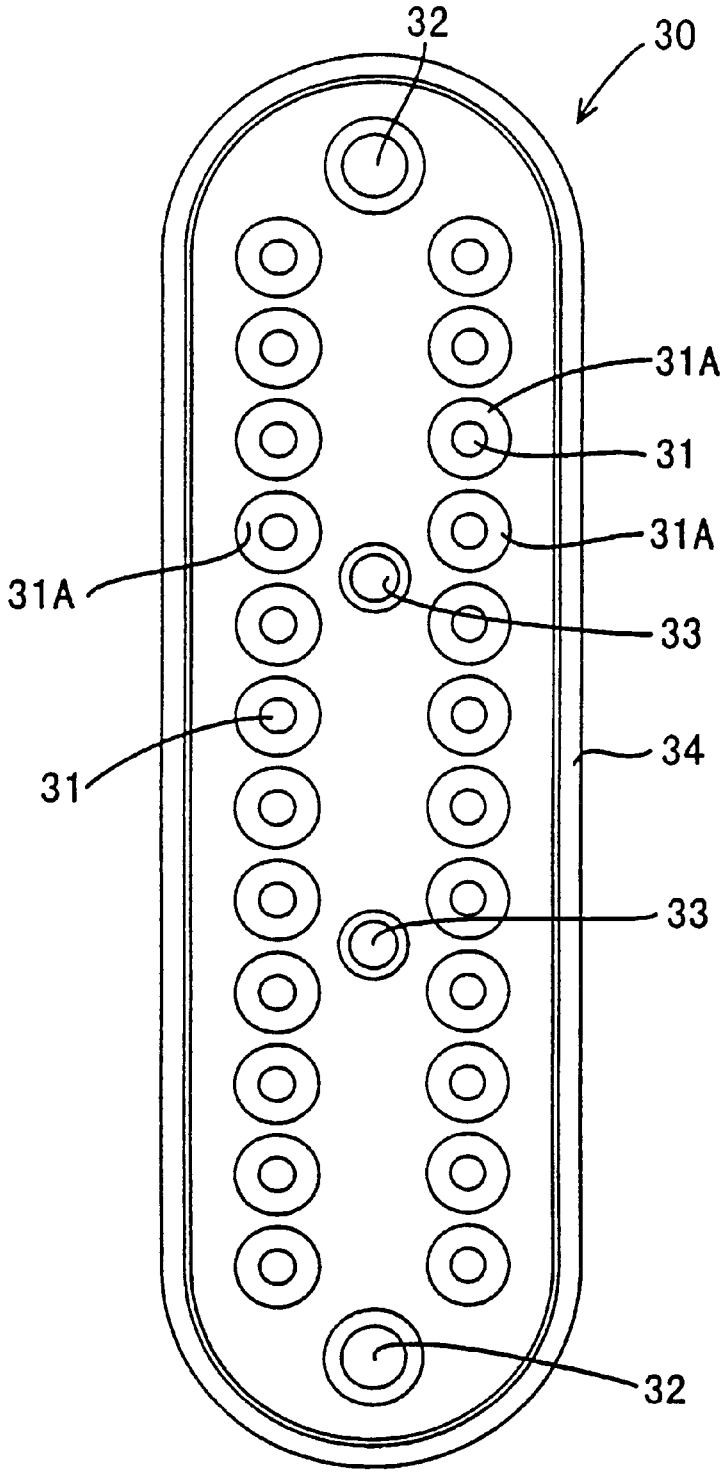
FIG. 12 is a rear view of the sealing member.
Figure 13:
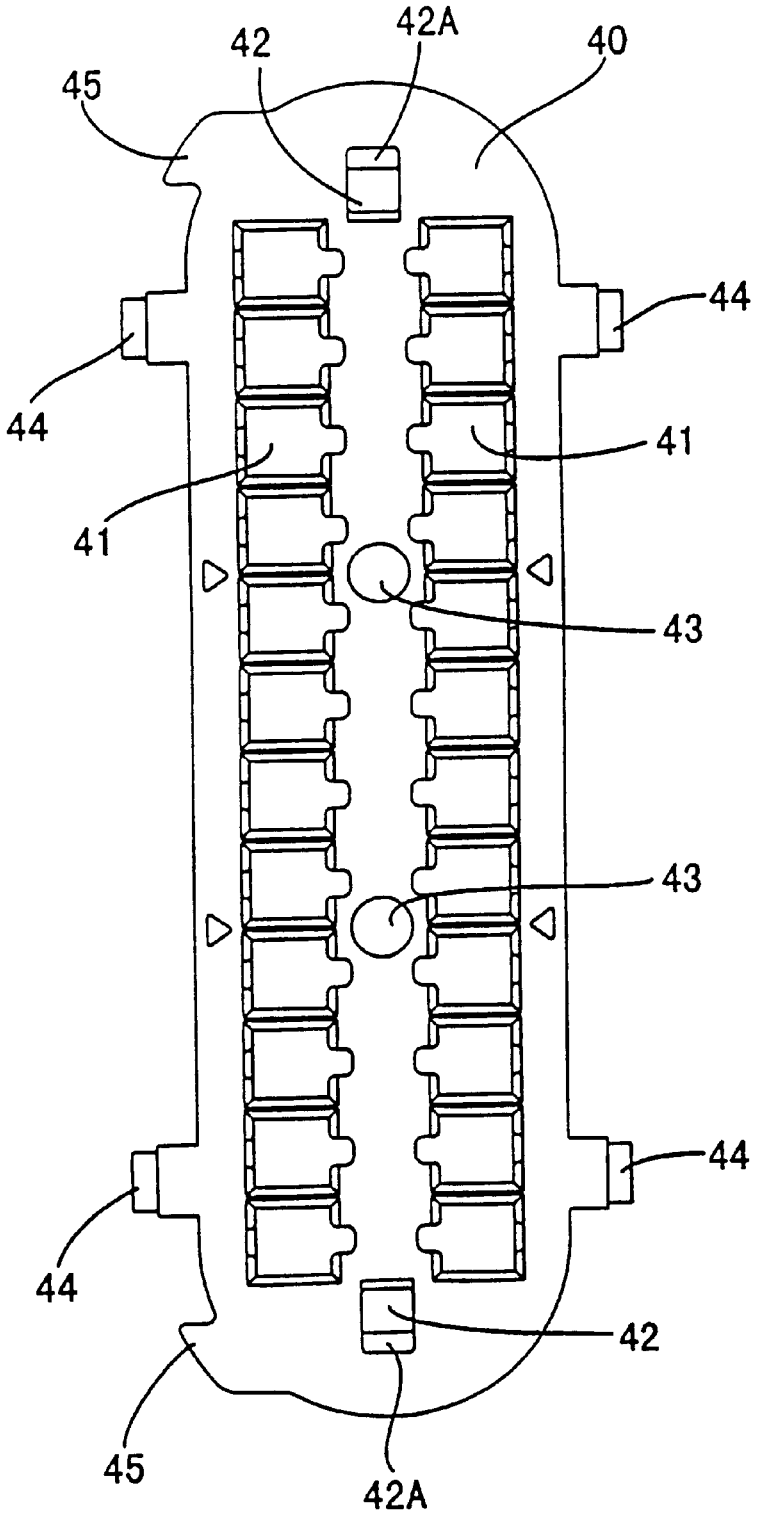
FIG. 13 is a rear view of the seal holder.

As shown in FIG. 11, the holding projections 14 include a base portion 14A and a locking portion 14B. As the base portions 14A pass through the fit-in holes 32, the locking portions 14B enter removal prevention holes 42 and engage with stepped receiving portions 42A, preventing the housing 10, the sealing member 30 and the seal holder 40 from being separated. The deformation prevention projections 15 also pass through the fit-in holes 33 and enter deformation prevention holes 43. The deformation prevention projections 15 prevent deformation of the sealing member 30.

The inner diameters of the fit-in holes 32 and 33 are smaller than the holding projections 14 and deformation prevention projections 15, respectively. Thus, when the holding projections 14 and the deformation prevention projections 15 pass the fit in holes 32 and 33, respectively, the holding projections 14 and the deformation prevention projections 15 contact fit-in holes 32 and 33 with elasticity, sealing around the holding projections 14 and deformation prevention projections 15.

The peripheral edge of the sealing member 30 is formed as a corrugated sealing edge. A lip portion 34 has, for example, three convexities approximately semi-circular in section and extending circumferentially around the sealing member 30. The lip portion 34 contacts the inner peripheral surface of the cap 60 elastically, thus sealing between the sealing member 30 and the cap 60 as shown in FIG. 4.

The seal holder 40 is made of a relatively rigid synthetic resin material. Similarly to the sealing member 30, the seal holder 40 may be oval-shaped and thick as shown in FIG. 1. The lip portion 34 formed on the periphery of the sealing member 30 is slightly larger than the periphery of the seal holder 40. A plurality of terminal insertion openings 41 extend through the seal holder 40 in correspondence to the cavities 11 and the sealing holes 31. Each terminal 20 is inserted into a respective cavity 11 through a respective terminal insertion opening 41.

As shown in FIG. 1 and FIG. 4, locking projections 44 are formed at each end of upper and lower surfaces of the seal holder 40. The locking projections 44 engage the cap 60, thus hindering the cap 60 from being easily removed from the housing 10, the sealing member 30, and the seal holder 40. An index projection 45 is formed in each circular arc-shaped region located at right and left ends of the peripheral surface of the seal holder 40. Each of the index projections 45 is formed such that the inward side thereof is on a level higher than that of the outward side thereof. The index projections 45 serve as an index for checking the upper and lower sides of the housing 10 when the terminal fixtures 20 are inserted into the cavities 11 and when the housing 10 is inserted into the cap 60.

Figure 2:
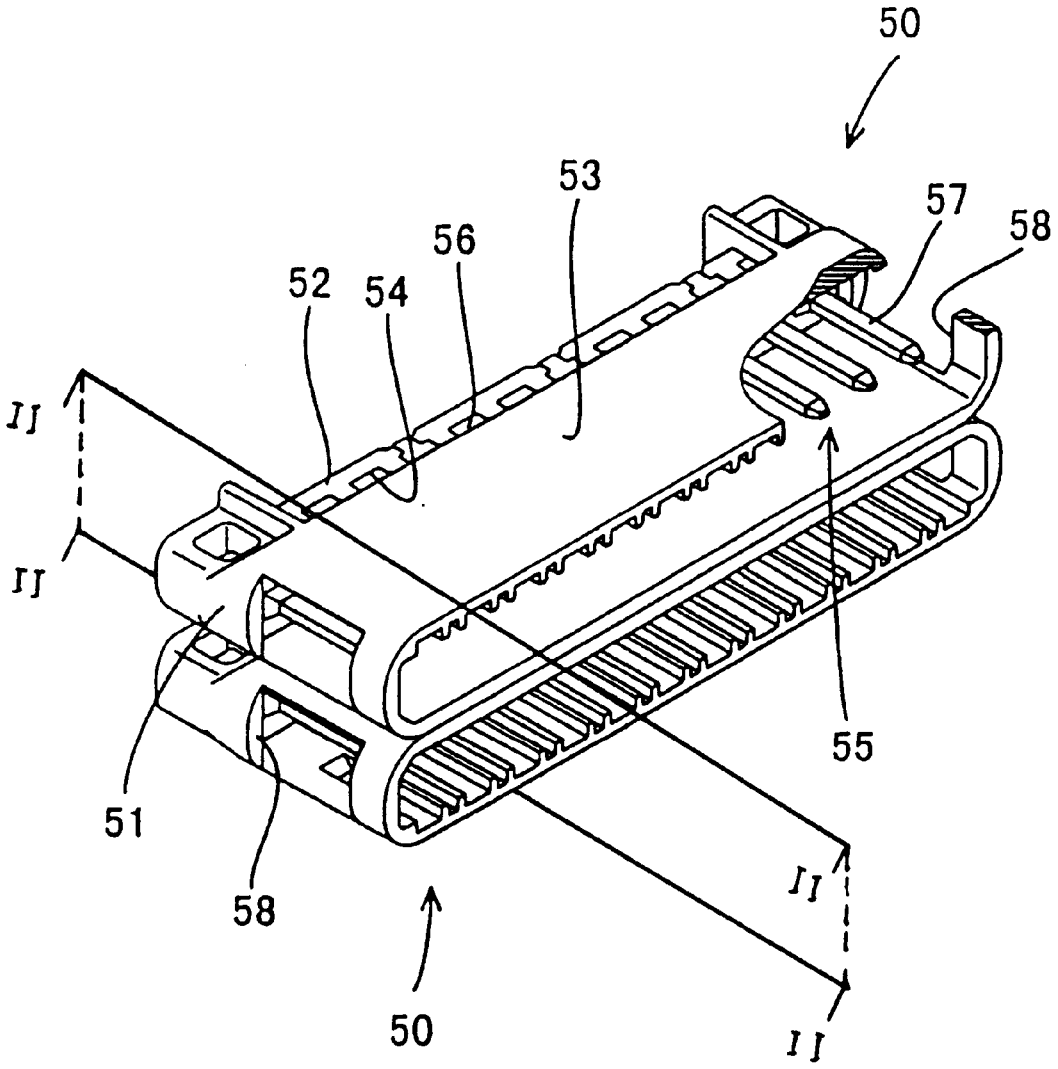
FIG. 2 is a partly cut-away perspective view of bus bar holders that engage the housing, seal member and seal holder of FIG. 1.
Figure 6:
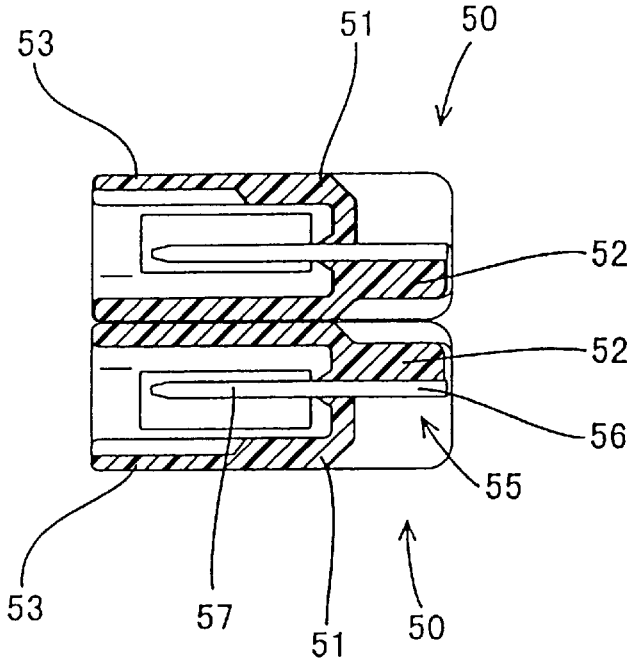
FIG. 6 is a sectional view on plane II—II of FIG. 2.

As shown in FIGS. 2, 4 and 6 each bus bar unit 50 is composed of a holding member 51 made of a relatively rigid synthetic resin material and a metal bus bar 55 that is integrated with the holding member 51 by insert molding. The holding member 51 has a wide sheet-shaped holding portion 52 and a flat cylindrical portion 53 projecting from the sheet-shaped holding portion 52. The bus bar 55 includes a plurality of connection pieces 57 projecting in parallel with each other, each in the shape of a cantilever, from an edge of a belt-shaped carrier 56. The bus bar 55 is held with the carrier 56 disposed along the sheet-shaped holding portion 52 and with connection pieces 57 facing the cylindrical portion 53. Punched holes 54 are formed on the sheet-shaped holding portion 52 in correspondence to the gap between adjacent connection pieces 57 projecting from the carrier 56. In the process of producing the bus bar units 50, a portion of the carrier 56 facing each punched hole 54 is punched with a punch and die in correspondence to a predetermined connection pattern. As a result, the carrier 56 is divided (not shown) into a plurality of bus bars 55. One bus bar 55 has at least three connection pieces 57. A plurality of terminals 20 are connected by each bus bar 55 through the connection pieces 57.

Each bus bar unit 50 is installed on the housing 10 in a direction forward therefrom such that the cylindrical portion 53 covers the upper-row cavities 11 or the lower-row cavities 11. When each bus bar unit 50 has been installed on the housing 10, the connection pieces 57 are connected with the terminals 20. Connection patterns can be discriminated from each other by, for example, changing the color of the holding member 51 of the bus bar unit 50. The upper part of the holding member 51 and the lower part thereof are not symmetrical. Thus, the correct bus bar unit 50 can be installed on the housing 10 in a correct direction, and a group of the terminals 20 can be connected in a correct pattern by checking colors and directions of the holding members 51.

As shown in FIG. 2, guide grooves 58 extend longitudinally and are formed at each of right and left widthwise edges of the cylindrical portion 53. As shown in FIG. 1, front and rear locking projections 17 and 18 correspond positionally to the guide groove 58 and are formed on the housing 10. Each bus bar unit 50 is brought to a temporary locking position with the locking projections 18 locked in the guide grooves 58. In this state, the bus bar unit 50 is held at a temporary locking position. In this state, each connection piece 57 is placed at a retracted position at which the connection piece 57 is not in contact with each terminal 20, thus preventing generation of resistance at the time of insertion of the terminals 20. The bus bar unit 50 is then brought to the final installation position by locking the front and rear ends of the guide groove 58 by the locking projections 17 and 18, respectively. In this state, the front and rear ends of the guide groove 58 sandwich the locking projections 17 and 18.

Each bus bar unit 50 can be used to detect the inserted state of the terminals 20. As shown in FIG. 8, the cylindrical portion 53 is installed on the housing 10 by sliding it along the surface 10A of the housing 10. An inclined surface 53A is formed on the front-end surface of the cylindrical portion 53 such that the outer side thereof extends further than the inner side (housing side) thereof. The inner-side edge of the inclined surface 53A is a prevention edge 53B that contacts the excess-flexure prevention surface 12C of the locking lances 12. The outer-side edge of the inclined surface 53A is a balancing edge 53C which contacts the balancing surface 12D of the locking lances 12. When the bus bar unit 50 has been fully inserted to the housing 10, the front end of the cylindrical portion 53 covers the outer surface of the front portion of the locking lances 12.

Figure 3:
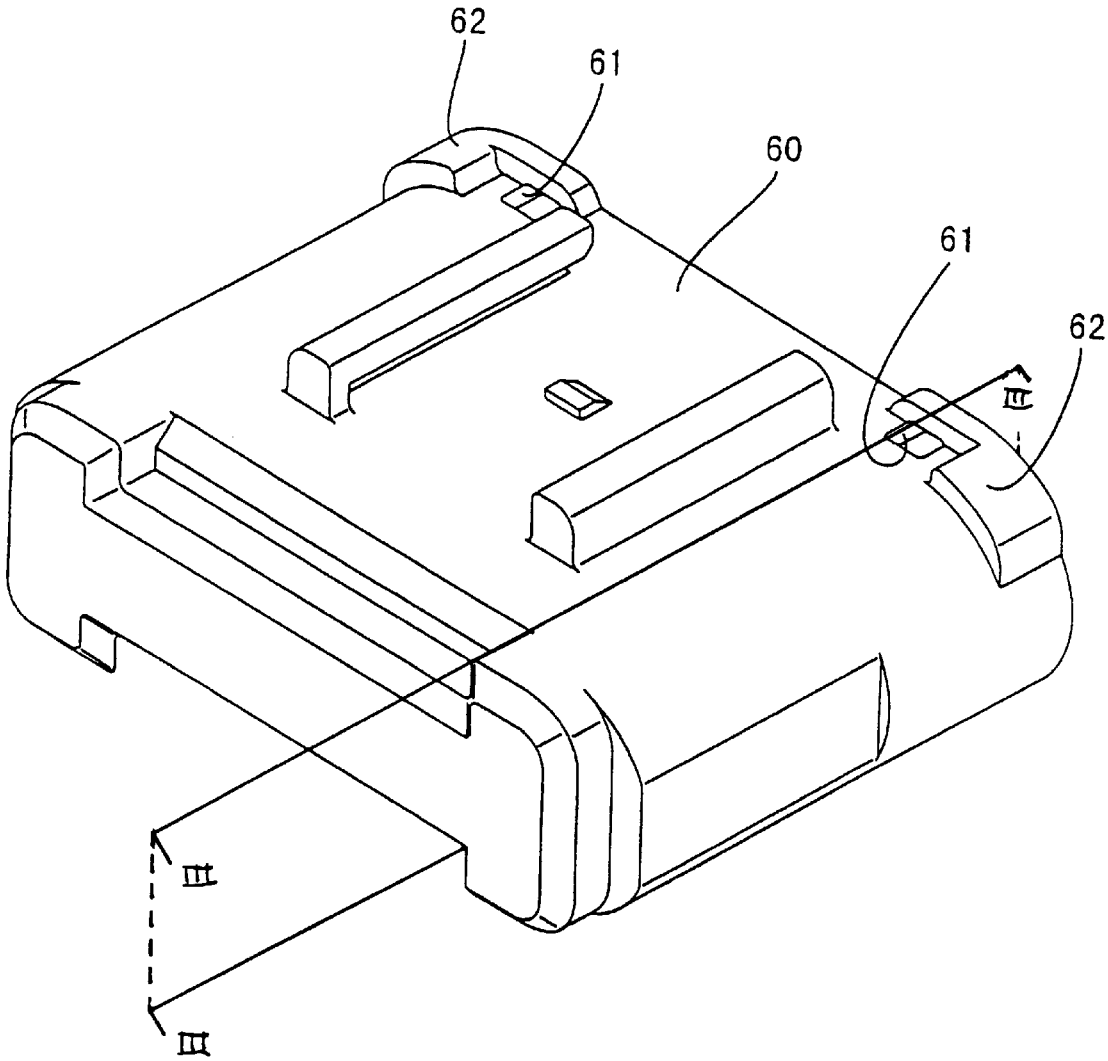
FIG. 3 is a perspective view of a cap that covers the housing of FIG. 1 and the bus bar holders of FIG. 2.
Figure 7:
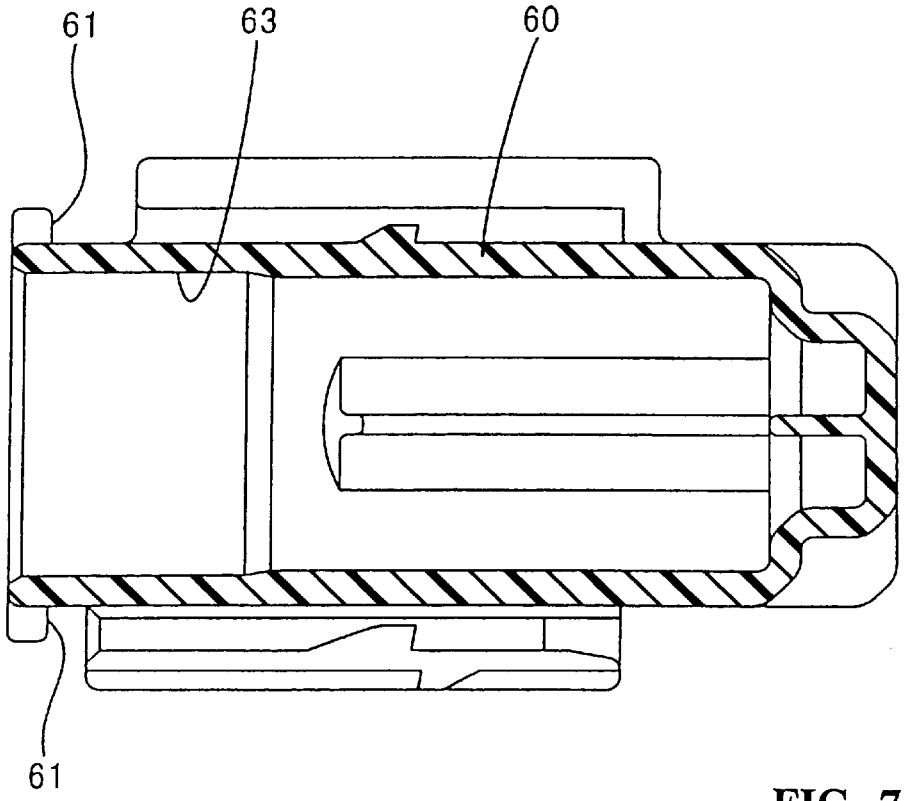
FIG. 7 is a sectional view on plane III—III of FIG. 3.

A description of the cap 60 is given with reference to FIGS. 3 and 7. The cap 60 is made of a relatively rigid synthetic resin material. As shown in FIG. 3, the cap 60 is oval-shaped in a front view and has a closed bottom. Locking holes 61 to which the locking projections 44 of the seal holder 40, shown in FIG. 1, lock are formed at an edge of an opening of the cap 60. The cap 60 is locked in the installed state by the engagement between the locking projections 44 and the locking holes 61. Relief portions 62 project outwardly and are formed on the edge of the opening of the cap 60 to prevent the cap 60 from interfering with the index projections 45 of the seal holder 40. As shown in FIG. 7, a region of the inner peripheral surface of the cap 60 near the edge of the opening is formed as a sealing surface 63 with which the lip portion 34 formed on the peripheral edge of the sealing member 30 contacts elastically (see FIG. 4).

The connector assembly procedure is as follows:

Initially, the sealing member 30 is sandwiched between the seal holder 40 and the housing 10. Then, the projections 14 formed on the housing 10 are passed through the sealing member 30, and locking portions 14B of the projections 14 are locked to the seal holder 40. This locks the seal member 30 to the housing 10, and the removal of the seal holder 40 is prevented. Then, terminals 20 are inserted through the terminal insertion openings 41 and the sealing holes 31 into respective cavities 11. Thereafter, each bus bar unit 50 is installed at a temporary locking position on the housing 10, and the bus bar unit 50 is placed on an assembling apparatus (not shown). Then, each bus bar unit 50 is pressed to a normal installation portion from the temporary locking position. As a result, the terminals 20 are connected in a predetermined pattern. When the bus bar units 50 are in the normal installing position, the cap 60 is installed on the housing 10 in such a manner that the cap 60 covers the housing 10 and the bus bar unit 50 as shown in FIG. 4.

The lip portions 34 formed on the periphery of the sealing member 30 prevent water from penetrating into the cap 60 between the inner periphery of the cap 60 and the periphery of the sealing member 30. Further, the lip portions 31A of the sealing holes 31 contact the periphery of the wires 25 closely, the inner periphery of each fit-in hole 32 contacts the periphery of the corresponding holding projection 14, and the inner periphery of the fit-in hole 33 contacts the periphery of the deformation prevention projection 15. Therefore, water can be prevented from penetrating into the sealing member 30 from outside.

On installation of each bus bar unit 50 on the housing 10 when all the terminals 20 are fully inserted into their respective cavities 11, each locking lance 12 is undeformed so that its outer surface 12A is flush with the outer surface 10A of the housing 10. Accordingly, when the cylindrical portion 53 slides over the outer surface 10A of the housing 10 during bus bar unit installation, the cylindrical portion 53 does not interfere with the locking lances 12. Thus, each bus bar unit 50 can be installed on the housing securely. When each bus bar unit 50 has been installed on the housing 10 in the normal state, the cylindrical portion 53 faces the locking lances 12 in such a manner that the inner surface of the cylindrical portion 53 holds downward on the outer surfaces 12A of the locking lances 12. Thus, the locking lances 12 are prevented from being elastically displaced in a direction which would move them away from the terminals 20 (see FIG. 8).

On the other hand, if there is any terminal 20 inserted into the cavity 11 incompletely, the removal prevention projection 12B interferes with the outer surface of the mating portion 21 of the terminal 20. Thus, the locking lance 12 is elastically displaced outward and projects outward from the outer surface 10A of the housing 10. During installation of each bus bar unit 50 on the housing 10, the inclined surface 53A that is formed at the front end of the cylindrical portion 53 then contacts the outer-side edge of the locking lance 12. As a result, the installation operator notices that the installation resistance is suddenly increased. In this manner, the operator can detect that a terminal is in the incomplete insertion state (see FIG. 9).

The operator suspends the installation operation with the connector in the state shown in FIG. 9 and resumes the installation operation after inserting the terminal 20 into the normal position of the cavity 11. However, it may happen that the operator continues to perform the installing operation without noticing a sudden increase in installation resistance. The locking lance 12 shown in FIG. 9 is then displaced upward by a force acting in the bus bar unit installation direction, the balancing edge 53C of the cylindrical portion 53 contacting and transmitting the force to the balancing inclined surface 12D. If the locking lance 12 were to flex upward further and exceed the limit of its elasticity, it would not be restorable to the undeformed state shown in FIG. 8. However, this is prevented because when the locking lance 12 flexes further, to a position still within its elastic limit, the prevention edge 53B of the cylindrical portion 53 contacts the excess-flexure prevention surface 12C (see FIG. 10). The excess-flexure prevention surface 12C has an inclination such that the locking lance 12 is urged in the opposite (elasticity-restoring) direction by the collision force of the cylindrical portion 53 applied to the excess-flexure prevention surface 12C. Thus, the locking lance 12 is prevented from being elastically displaced further.

As described above, as a mechanism to prevent the locking lances 12 from flexing excessively beyond the limit of their elasticity, the cylindrical portion 53 is pressed against the excess-flexure prevention surface 12C. Thus, it is also unnecessary to provide the housing 10 with a wall for preventing excess deformation of the locking lance 12, which makes it possible to reduce the width of the housing 10.

When the cylindrical portion 53 of each bus bar unit 50 contacts both the excess-flexure prevention surface 12C and the balancing surface 12D, as shown in FIG. 10, the locking lances 12 are prevented from being displaced in either direction. Thus installation of the bus bar unit 50 on the housing 10 is prevented. That is, even if the bus bar unit 50 is pressed strongly against the lances 12, the lances 12 are prevented from being forcibly displaced in the elasticity-restoring direction. In particular, when the cylindrical portion 53 contacts the balancing surfaces 12D, the locking lances 12 are spaced from the terminals 20. Therefore, even though the locking lance 12 may be displaced slightly in the elasticity-restoring direction, there is no possibility that the locking lance 12 is urged excessively against the terminals 20.

The acute angle α formed between the insertion direction of the cylindrical portion 53 and the excess-flexure prevention surface 12C is smaller than the angle β which formed between the insertion direction and the balancing surface 12D. Thus, when a force acting in the installation direction is initially applied to the locking lances 12 by the cylindrical portion 53, the resultant force that is applied to the locking lances 12 in the downward (elasticity-restoring) direction (i.e., torward the cavity) is greater than the resultant force that is applied in the upward (increased elastic displacement) direction (i.e., away from the cavity). Accordingly, it is possible to prevent excess deformation of the locking lances 12.

The inclined surface 53A of the cylindrical portion 53 may be inclined with respect to the bus bar unit-installation direction, as shown in the drawings. Therefore, even if the locking lances 12 may be slightly raised with respect to the outer surface 10A of the housing 10 when the terminals 20 are fully inserted, the lances 12 are not snagged by prevention edge 53B of the cylindrical portion 53 during installation of each bus bar unit 50 into the housing 10.

The present invention is not limited to the embodiments described, but may be varied, for example, as described below.

(1) In the above description, the front end surface of the cylindrical portion 53 of the bus bar unit 50 is angled and the edges of the surface contact the excess-flexure prevention surface 12C and the balancing surface 12D. However, within the present invention, the front end surface of the cylindrical portion 53 may be V-shaped so that the end surface corresponds to and contacts the excess-flexure prevention surface 12C and the balancing surface 12D.

(2) In the above description, the acute angle α between the insertion direction of the cylindrical portion 53 and the excess-flexure prevention inclined surface 12C is smaller than the angle β between the insertion direction and the balancing inclined surface 12D. However, within the present invention, although less desirably, angle α may be larger than angle β or angle α may be equal to angle β.

(3) In the above description, the balancing surface 12D is in addition to the excess-flexure prevention surface. However, within the present invention, it is possible to form only the excess-flexure prevention inclined surface.

(4) In the above description, the end surface of the cylindrical portion 53 is angled relative to the insertion direction of the cylindrical portion. However, according to the present invention, the end surface of the cylindrical portion 53 may be perpendicular to the insertion direction, or may be angled in the opposite direction.

(5) In the above description, the cylindrical portion 53 initially contacts the outer-side edge of the locking lance 12 when a terminal is partially inserted. However, within the present invention, the cylindrical portion 53 may contact an inclined surface of the locking lance 12 initially. In this case, the locking lance 12 first contacts the balancing surface 12C, and thereafter the excess-flexure prevention surface 12D after slight displacement of the locking lance 12. Alternatively the cylindrical portion 53 may contact both inclined surfaces.

(6) In the above description, a connector of waterproof type has been described. However, the present invention is also applicable to connectors of non waterproof type.

Although the invention has been described above in relation to particular embodiments, many variations are possible within the spirit and scope of the invention herein described, as will be appreciated by those who are skilled in the art, once given this disclosure.

What is claimed is:

1. A connector comprising:

a housing having an outer peripheral surface, a plurality of cavities, a plurality of resiliently deformable locking members, and a plurality of terminals, each of said terminals being inserted in a respective one of said cavities and having (a) a partially inserted position in which said terminal bears on said locking member to deform said locking member so that said locking member is deflected outward of said outer peripheral surface, and (b) a fully inserted position in which said locking member snap-fits to said terminal thereby locking said terminal in said cavity; and a bus bar holder having a sleeve and a plurality of bus bar tab pieces said bus bar tab pieces being accommodated in said sleeve, and said sleeve being push-fitted onto said peripheral surface of said housing to install said bus bar holder to said housing and to contact said tab pieces to said terminals, whereby said terminals are electrically connected to each other;

wherein each locking member has a first end surface portion which is inclined with respect to a push-fit direction of said sleeve, whereby when one or more of said terminals are in said partially inserted position with one or more respective said locking members deflected outward of said outer peripheral surface when push-fitting said sleeve onto said housing, said sleeve bears on said end surface portion to urge the one or more said locking members toward said terminal thereby preventing excess deformation of the one or more said locking members.

2. The connector according to claim 1, wherein each said locking member has a second end surface portion which faces said first end surface portion and, with respect to said first end surface portion, is oppositely inclined with respect to the push-fit direction of said sleeve, whereby when, on push-fitting of said sleeve onto said housing, each of said terminal is in said partially inserted position with the respective said locking member deflected outward of said outer peripheral surface, said sleeve bears on said second surface portion to urge said locking member away from said terminal.

3. The connector according to claim 2, wherein said first and second end surface portions define a V-shaped recess in said locking member.

4. The connector according to claim 2, wherein said first and second end surface portions are formed so that when, on push-fitting of said sleeve onto said housing, said terminal is in said partially inserted position with each of said locking member deflected outward of said outer peripheral surface, said sleeve bears on both said first and said second end surface portions.

5. The connector according to claim 4, wherein said first and said second end surface portions are formed so that when said sleeve bears on both said first and said second end surface portions, an angle of inclination of said first end surface portion with respect to said push-fit direction is smaller than the angle of inclination of said second end surface portion with respect to said push-fit direction.

* * * * *